US011452429B2

(12) United States Patent
Bajwa et al.

(10) Patent No.: US 11,452,429 B2
(45) Date of Patent: Sep. 27, 2022

(54) INNOVATIVE UPRIGHT DUSTPAN

(71) Applicants: Bilal Arshad Bajwa, Raleigh, NC (US); Mohammad Safarish, Cary, NC (US)

(72) Inventors: Bilal Arshad Bajwa, Raleigh, NC (US); Mohammad Safarish, Cary, NC (US)

( * ) Notice: Subject to any disclaimer, the term of this patent is extended or adjusted under 35 U.S.C. 154(b) by 173 days.

(21) Appl. No.: 17/013,560

(22) Filed: Sep. 5, 2020

(65) Prior Publication Data

US 2021/0068609 A1 Mar. 11, 2021

Related U.S. Application Data

(60) Provisional application No. 62/898,292, filed on Sep. 10, 2019.

(51) Int. Cl.
*A47L 13/52* (2006.01)

(52) U.S. Cl.
CPC ..... *A47L 13/52* (2013.01)

(58) Field of Classification Search
CPC ..... A47L 13/52
USPC ..... 15/257.1, 257.4, 257.5, 257.6, 257.7, 15/257.8
See application file for complete search history.

(56) References Cited

U.S. PATENT DOCUMENTS

| | | | | | |
|---|---|---|---|---|---|
| 768,871 | A * | 8/1904 | Albertson | A47L 13/52 | 15/257.3 |
| 1,053,438 | A * | 2/1913 | Resch | A47L 13/52 | 15/257.3 |
| 1,223,105 | A * | 4/1917 | Pigott | A47L 13/52 | 15/257.3 |
| 4,709,440 | A * | 12/1987 | Conelly | E01H 1/006 | 15/257.3 |
| 6,233,780 | B1 * | 5/2001 | Mead | A47L 13/52 | 15/257.3 |
| 6,643,892 | B1 * | 11/2003 | Murphy | A47L 13/52 | 15/257.3 |

* cited by examiner

*Primary Examiner* — Randall E Chin

(57) ABSTRACT

A hands-free, easy to use, manufacture and assemble upright dustpan with a hinged back door. The dustpan can pivot on the main body and the hinged back-door can be locked or unlocked via a latching mechanism and a trigger, all located on the dustpan's main body. When the latching mechanism is triggered, the hinged back door opens either under its own weight or under the weight of the debris and thus allows debris to leave the compartment and fall into the waste receptacle when the dust pan is held above the waste receptacle in pivoted orientation. The trigger can be actuated by the edge of the waste receptacle, or any rigged body. Whereas the hinged back door can be closed back by tapping on the floor.

7 Claims, 4 Drawing Sheets

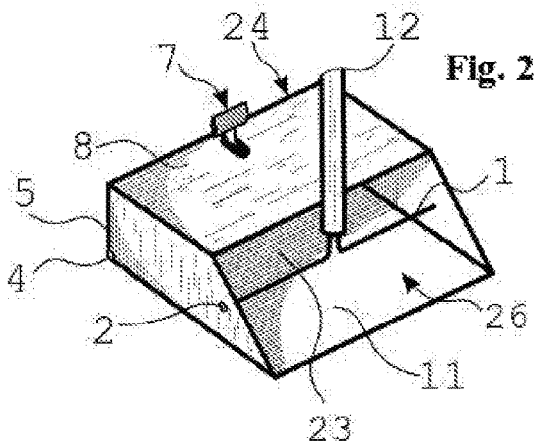
Fig. 2
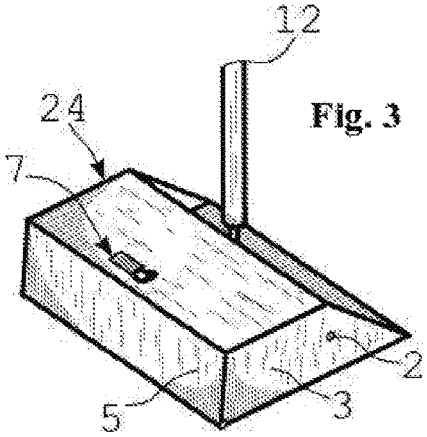
Fig. 3
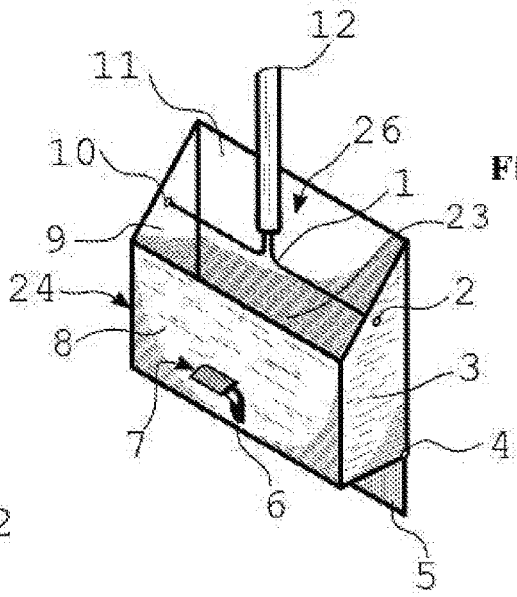
Fig. 4
Fig. 5
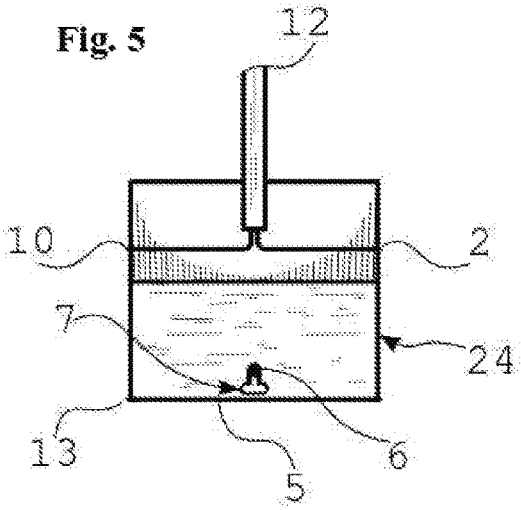
Fig. 6
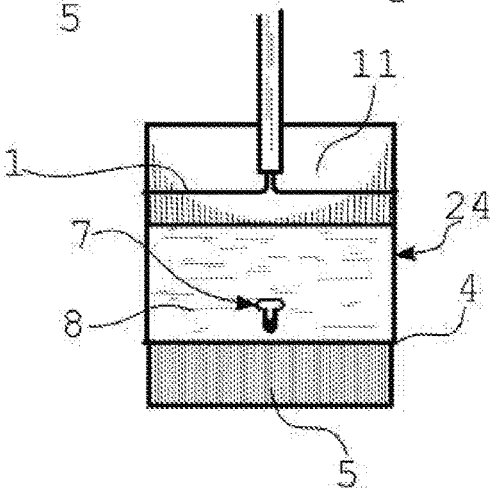

Fig. 7
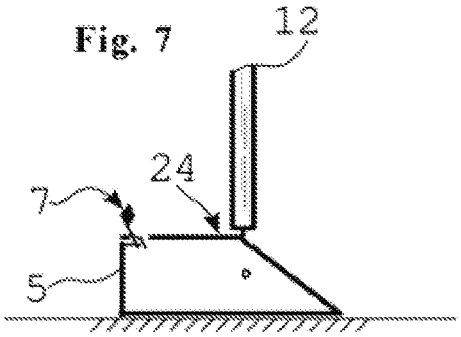
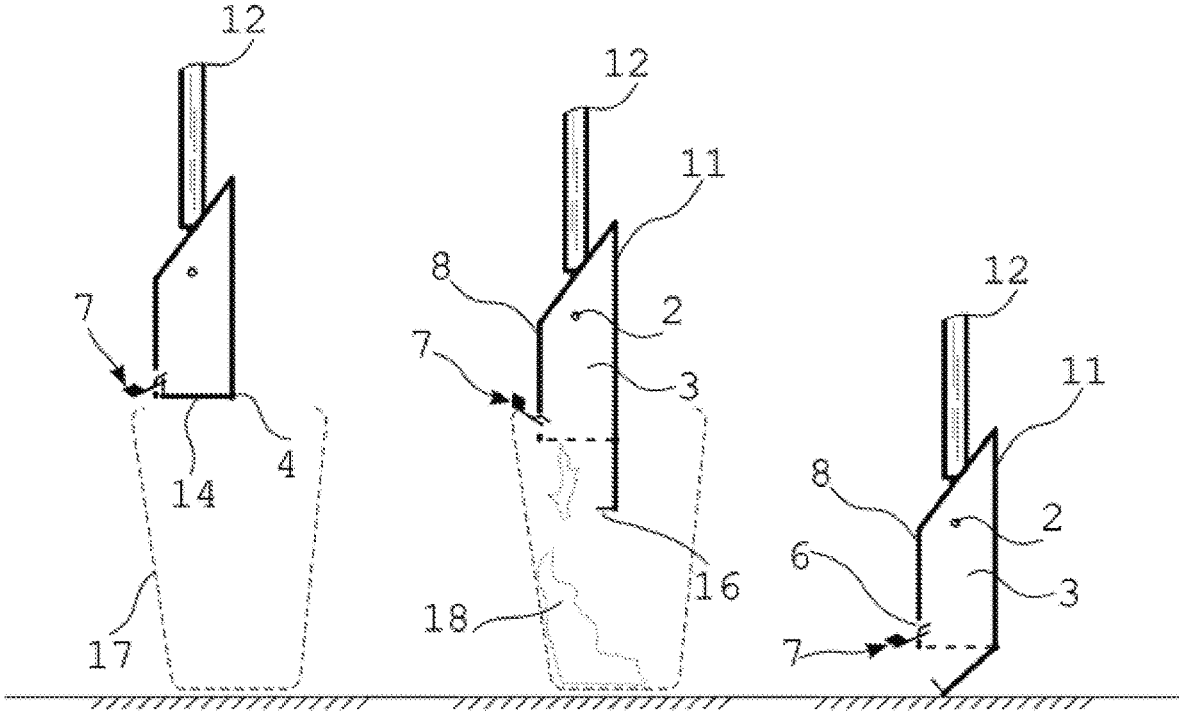
Fig. 8A Fig. 8B Fig. 8C

INNOVATIVE UPRIGHT DUSTPAN

CROSS-REFERENCE TO RELATED APPLICATIONS

The present application claims priority to 62/898,292, filed on Sep. 10, 2019 entitled "Innovative Upright Dustpan", the disclosure of which is hereby incorporated in its entirety at least by reference.

BACKGROUND OF THE INVENTION

1. Field of the Invention

The present invention relates to waste receptacles, more specifically to a dustpan for consumer and business floor cleanliness.

2. Description of Related Art

Sweeping the floor with a brush or broom has been an essential part of cleaning since the dawn of civilization. The broom is usually used to accumulate debris and dust in one place. Thereafter, many different types of devices have been used throughout history to dispose of the accumulated debris. A dustpan is one of the devices in recent history that has proven to be very useful in receiving and transporting the accumulated debris from the floor to the waste receptacle.

One well-known type of dustpan is of the upright type. The basic components of an upright dustpan are a long handle and a main body to receive the accumulated debris from the floor. The upright dustpan with pivoting main body has an added benefit of keeping the debris contained in the container and thus keeping it from spilling unintentionally. Moreover, it promotes smaller foot-print to save storage space and hides the debris deep in the container. Some dustpans also have a lid that closes when pivoted for storage purposes to contain the odor of the debris and keep insects away.

In most upright dustpans the main body connects to the handle via a pivotal joint and has a single opening for collecting and disposing of the debris. The dustpan's main body rotation about the pivot is free form resulting in uncontrolled rotation of the main body in different orientations. The uncontrolled motion of the main body requires using both hands to control the motion of the main body when disposing the debris and dust into the waste receptacle. For instance, in a biohazard area, it is of primary importance to minimize risk of direct exposure to any kind of debris; however, the use of second hand to dispose debris from the dustpan pose a serious threat of exposure as its touching the contaminated areas of the dustpan. The main disadvantage of these upright dustpans is that they require user's both hands to control the rotation of the main body for the disposal of debris.

Few upright dustpans in prior art have a trap door that is actuated by trigger on the long handle. This type of upright dustpan uses complex mechanisms involving cables, pulleys, etc. which also results in complex manufacturing practices and higher costs. Many times, in household, public or business settings, waste receptacles have a small opening which does not allow room for the dustpan to practice free form maneuverability which results in either debris falling out of the waste receptacle or dustpan getting stuck in the waste receptacle.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The present disclosure relates to an upright dustpan comprising an elongated handle and a main body/collecting pan with a hinged back door that can be actuated in a hands-free way via a trigger located on the collecting pan. The trigger can be actuated by the edge of the waste receptacle or any rigged body thus making it hands free for the user.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which:

FIG. 2 is a perspective front view of the present invention

FIG. 3 is a perspective back view of the present invention with the back door closed FIG. 4 is a perspective view of the present invention with the back door open FIG. 5 is an upright front view of the present invention with the door closed FIG. 6 is an upright front view of the present invention with the door open FIG. 7 shows ready position for use of the present invention when placed upon the floor.

FIGS. 8A-C shows the hands free operational steps of the present invention

DETAILED DESCRIPTION OF THE PREFERRED EMBODIMENT

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide an innovative upright dustpan.

Figure 1:
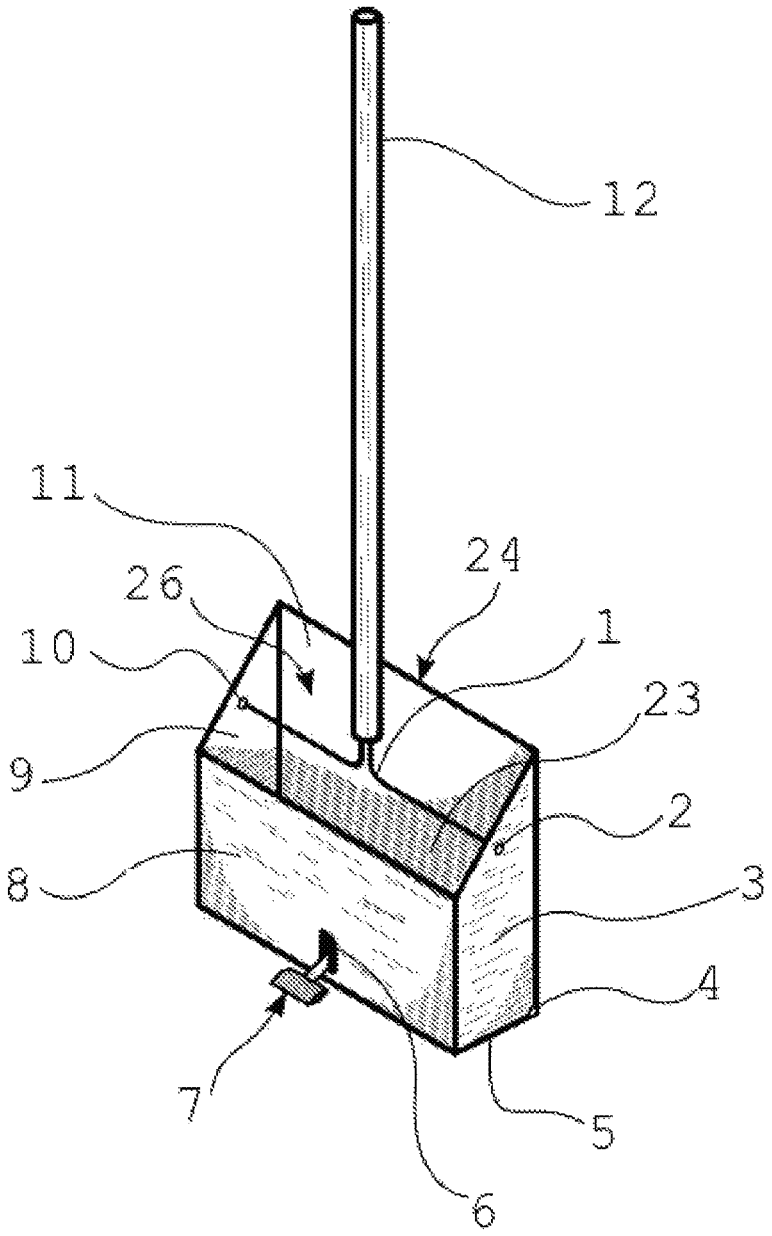
FIG. 1 is a perspective view of the present invention.

Referring now to the drawings, FIG. 1 illustrates an upright dustpan according to one exemplary embodiment is shown. The dustpan generally comprises an elongated handle (12) and a main body (24). As shown in FIG. 1, the main body (24) is comprised of a top face (8), a bottom face (11), side faces (9), (3), and a back door (5) that collectively define a collecting compartment (26) for dust and debris that is open at the front. The back door (5) is pivotally connected to the bottom face (11) and is movable from a closed position to an open position for disposing dust and debris from the main body (24).

The main body (24) is connected to a long handle (12) via two wires (1), which are pivotally connected to the respective side wall (3), (9) of the main body (24) at holes (2) and (10) so that the main body/collecting pan (24) can freely pivot relative to the handle (12). When the main body/collecting pan (24) is lifted above the floor, the main body/collecting pan rotates to an upright position as shown in FIG. 4.

The back door (5) of the main body/collecting pan is connected to the bottom face (11) by a piano hinge (4). The back door (5) is movable between a closed position for containing dust and debris inside the collecting compartment (26) an open position for dumping the contents of the collecting compartment into a waste bin. A releasable latching mechanism (7) holds the back door (5) in a closed position until the latching mechanism (7) is actuated. One aspect of the present disclosure is the ability to release the latching mechanism (7) in a hands-free manner, i.e., without requiring the use of hands to release the latch.

Figures 9A, 9B, 9C, 9D:
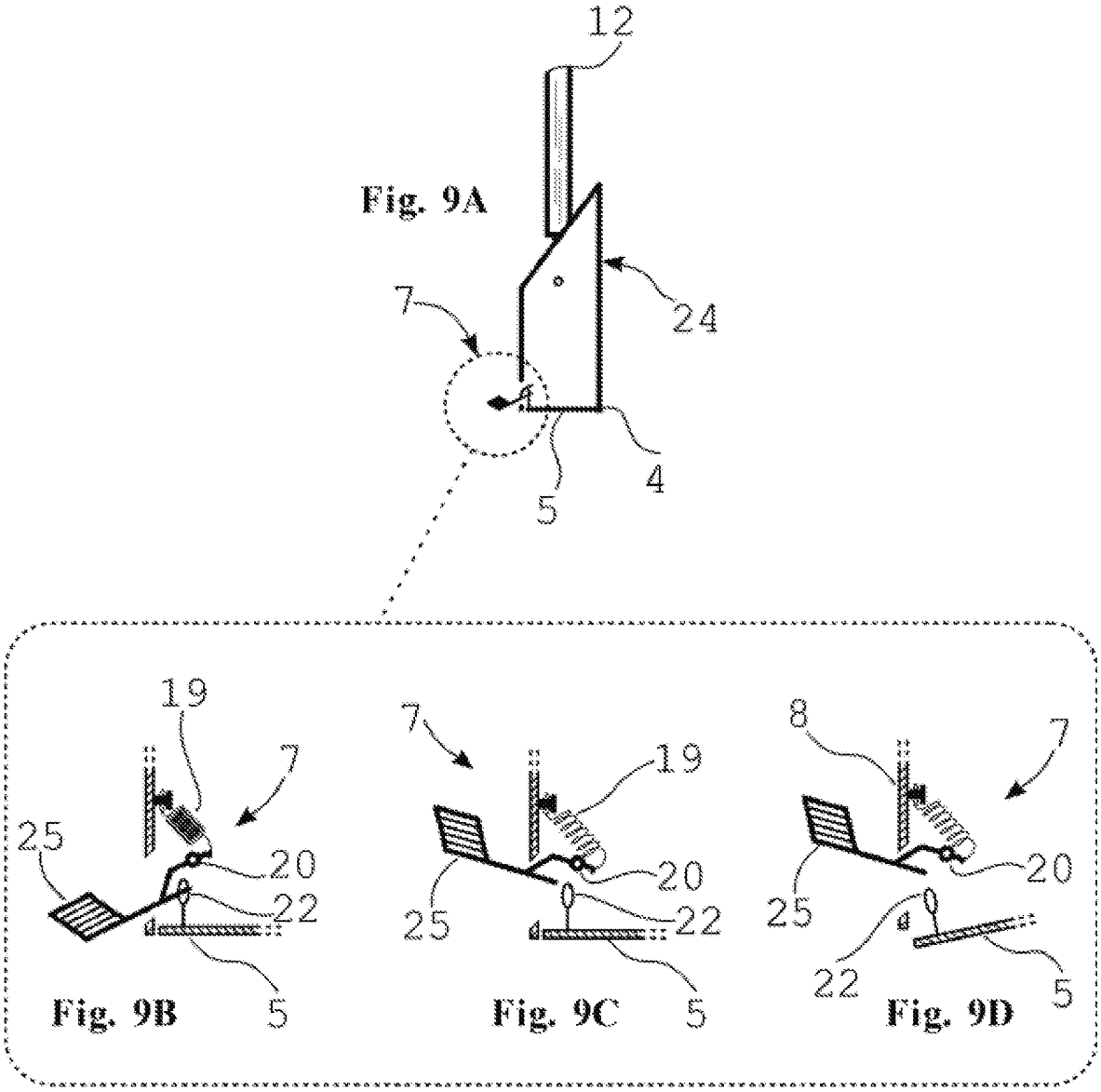
FIGS. 9A-D shows an example of a latch mechanism, its states and location

FIG. 9B, FIG. 9C, and FIG. 9D shows an example of a latching mechanism (7) in different states. The latching mechanism (7) generally comprises a latch (25) connected to the top face (8) of the main body (24) and a catch element (22) connected to the back door (5). The latch (25) rotates about a pivot (20) and is movable between a locked position and released position. In the locked position, the latch (25) engages the catch element (22) on the back door (5) to hold the back door (5) in the closed position as shown in FIG. 9B. In the released position from FIG. 9C to FIG. 9D, the latch (25) disengages from the catch element (22) on the back door (5) allowing the back door (5) to swing downward due to the weight of the back door (5) and/or debris in the collecting compartment. The latch (25) is biased to the locked position by a spring (19) or other biasing member.

FIG. 9A shows the side views of the dustpan when it's lifted off the ground just but before the latch (25) is released. In FIG. 9B, the latch (25) is in a locked position. Spring (19) keeps the latch (25) from rotating freely about the pivot (20) by keeping it in tension. The catch element (22) on the back door (5) is engaged and locked by the latch (25). In this setup, no matter the weight of the dust and debris, the back door (5) won't open unintentionally in any orientation.

FIG. 9C and FIG. 9D shows the latch (25) in an unlocked position. When the latch (25) is triggered, e.g., pushed by some external hands-free force, the latch (25) rotate about the pivot (20) and disengage from the catch element (22) and release the back door (5), which results in the back door opening by falling under its own weight or under the weight of the dust or debris. When the back door (5) opens, it swings on the hinge (4) located at the edge of the bottom face (11) of the main body (24). User can close the back door (5) by tapping the back door (5) of the main body (24) on the floor as shown in FIG. 8C. In this way, the back door (5) will swing back towards its closed position and the latch (25) will engage the catch element FIG. 9D (22) on the back door.

It is to be noted here that the latching mechanism (7) is not restricted to the type shown in FIG. 9B, FIG. 9C and FIG. 9D nor the orientation or location of the latch (7) is restricted to what is shown in FIG. 3 to FIG. 7.

During normal use, the main body/collecting pan (24) will lay flat on the floor with bottom surface (11) resting on the ground plane. FIG. 3 and. FIG. 4 shows the orientation of the dustpan when in use, i.e. laid horizontal on the floor, ready to receive dust and debris from the opening (23) where the long handle is also connected. In this orientation, it is intended that the back door (5) is in closed position so that the dust and debris is contained in the collecting compartment (26) of the main body (24).

When the main body (24) is lifted off the floor, the main body (24) pivots to an upright position as shown in FIG. 1 and FIG. 9A. In this upright position, dust and debris contained in the collection compartment (26) will fall against the back door (5), which is held in a closed position by the latching mechanism (7). FIG. 5 shows that the orientation of the main body (24) when it's lifted off the ground. While in this orientation, when the user wants to empty the dust and debris into the waste receptacle, the latch mechanism (7) is triggered hands-free by the edge of the trash can or any rigid body.

FIG. 8A, FIG. 8B and FIG. 8C show the process hands-free disposal. In FIG. 8A, the back door (5) is shown in closed position. In FIG. 8B, the edge of the waste receptacle triggers the example latching mechanism (7) by pushing the latch (25) upwards while the main body (24) is lowered into the waste receptacle. When the latch (25) is triggered, the back door (5) opens. FIG. 4 and FIG. 5 shows the open state of the back door (5).

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. An upright dustpan comprising:

a handle;

a main body pivotally attached to the handle, the main body comprising:

a pan defining a collecting compartment for collecting dust and debris;

an opening on a front side of the collecting compartment to receive the dust and debris into the collecting compartment; and a movable door on a back side of the collecting compartment configured to retain the dust and debris when the movable door is in a closed position and to empty the dust and debris from the collecting compartment when the movable door is in an open position;

a hands-free latching mechanism comprising a latch arm removably engaged in a catch element attached to the movable door, the hands-free latching mechanism configured to releasable secure the movable door in the closed position while the dustpan is used to collect the dust and debris, wherein the latch arm protrudes from the collecting compartment such that when engaged by an object, causes the hands-free latching mechanism to release the latch arm from the catch element transitioning the movable door in the open position to empty the dust and debris from the collecting compartment.

2. The upright dustpan of claim 1, wherein the movable door is pivotally connected to the bottom of the enclosed pan and forms a back wall of the collecting pan.

3. The upright dustpan of claim 1, wherein the latch arm is pivotally mounted to the top of the pan.

4. The upright dustpan of claim 3, wherein the hands-free latching mechanism further comprises a biasing member to bias the latching mechanism in the closed position.

5. The upright dustpan of claim 4, wherein the biasing member comprises a spring.

6. The upright dustpan of claim 1, wherein the pan is an enclosed pan.

7. The upright dustpan of claim 1, wherein the object is a lip of a waste receptacle.

* * * * *